US006661981B2

(12) United States Patent
Boothe et al.

(10) Patent No.: US 6,661,981 B2
(45) **Date of Patent: *Dec. 9, 2003**

(54) METHOD AND APPARATUS FOR CONTROLLING TRANSFER BELT VELOCITY OF A COLOR PRINTER

(75) Inventors: Richard M. Boothe, Lexington, KY (US); Danny K. Chapman, Nicholasville, KY (US); Mark A. Omelchenko, Lexington, KY (US); Gregory L. Ream, Lexington, KY (US); John P. Richey, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 143 days.

This patent is subject to a terminal disclaimer.

(21) Appl. No.: 09/977,618

(22) Filed: Oct. 15, 2001

(65) Prior Publication Data

US 2003/0072578 A1 Apr. 17, 2003

(51) Int. Cl.[7] ..... G03G 15/00; G03G 15/01; G03G 15/16

(52) U.S. Cl. ..... 399/44; 399/66; 399/78; 399/301

(58) Field of Search ..... 399/44, 66, 78, 399/301, 302, 308

(56) References Cited

U.S. PATENT DOCUMENTS 6,198,897 B1 * 3/2001 Ream ..... 399/301
6,301,451 B1 * 10/2001 Ando et al. ..... 399/301 X
6,363,228 B1 * 3/2002 Ream ..... 399/307 X

FOREIGN PATENT DOCUMENTS

JP 9-54476 * 2/1997
JP 10-213943 * 8/1998

* cited by examiner

*Primary Examiner*—Fred L. Braun
(74) *Attorney, Agent, or Firm*—Frederick H. Gribbell; John A. Brady

(57) ABSTRACT

Transfer belt subassembly for a color printer includes a transfer belt, home position indicator, temperature sensor, and memory. The transfer belt subassembly is measured and characterized after fabrication, before being installed in a printer. Measurement and calibration data for the transfer belt is stored in memory as part of the subassembly, including data representing velocity characteristics of the transfer belt and temperature compensation factors used by an engine-controller in a method to govern the speed of the drive motor. When the transfer belt subassembly is inserted into a printer, the engine-controller is operative in response to data stored in the memory and sensed belt velocity and temperature data, providing adjustment of belt velocity and compensation for variations in the transfer belt speed. Using the predetermined characterizing data, precise alignment of the color planes with respect to one another is achieved for accurate color printing.

35 Claims, 12 Drawing Sheets

170

AC Feed Forward

AC Table Phasing example

| Table location | Value | | Belt Zone |
|---|---|---|---|
| | | Previous Home sensor signal | |
| 1 | 1 | | 1 |
| 2 | 0 | | 2 |
| 3 | -1 | | 3 |
| . | . | | . |
| . | . | | . |
| 1687 | 1 | | 1687 |
| 1688 | 0 | | 1688 |
| 1689 | 1 | | 1689 |
| 1690 | 0 | End of Case A Sensor signal | 1690 |
| 1 | 1 | | 1691 |
| 2 | 0 | | 1692 |
| 3 | -1 | | |
| 4 | 0 | | |

Desired position

Last zone used =2
Went thru table "Too fast"

Rephasing of belt home signal to start of compensation table

Case A: The number of Belt zones is greater than the number of table zones (i.e. "Went through the table too fast")

Table_Zones = 1690
Last_Zone_Used = 2
Belt_zone_per_rev = 1692

Table size correction = Table_Zones − Belt_zones_per_rev
= 1690 − 1692 = −2

Position correction = −1 * Last_Zone_Used = −2

Total Correction = Table_size_correction + Position_correction
= −2 + −2 = −4

Correction Interval = [Belt_zones_per_rev/(|Total correction| + 1)] −1
=1692/( |−4| + 1 ) −1 = 337.4==>337

FIG. 9

AC Table Phasing example

| Table location | Value | | Belt Zone |
|---|---|---|---|
| 1 | 1 | Previous | 1691 |
| 2 | 0 | Home | 1692 |
| 3 | −1 | sensor | 1 |
| . | . | signal | . |
| . | . | | . |
| 338 | 0 | Correction #1 | 336 |
| | ... | at belt zone 337 | 337 |
| 339 | 1 | No correction | 338 |
| 340 | 1 | is made and the | 339 |
| . | . | compensation | . |
| . | . | table is shifted | . |
| . | . | down | . |
| . | . | | . |
| 674 | 0 | Correction #2 | 673 |
| | ... | at belt zone 674 | 674 |
| 675 | −1 | No correction | 675 |
| 676 | −1 | is made and the | 676 |
| . | . | compensation | . |
| . | . | table is shifted | . |
| . | . | down | . |
| . | . | | . |
| 1010 | 0 | Correction #3 | 1010 |
| | ... | at belt zone 1011 | 1011 |
| 1011 | 1 | No correction | 1012 |
| 1012 | 1 | is made and the | 1013 |
| . | . | compensation | . |
| . | . | table is shifted | . |
| . | . | down | . |
| . | . | | . |
| 1346 | 0 | Correction #4 | 1347 |
| | ... | at belt zone 1348 | 1348 |
| 1347 | −1 | No correction | 1349 |
| 1348 | −1 | is made and the | 1350 |
| . | . | compensation | . |
| . | . | table is shifted | . |
| . | . | down | . |
| . | . | | . |
| 1688 | 1 | | 1690 |
| 1689 | 1 | | 1691 |
| 1690 | 0 | Sensor signal | 1692 |
| 1 | 1 | Last zone used | 1 |
| 2 | 0 | =1690 | 2 |
| 3 | −1 | Belt and table | 3 |
| 4 | 0 | matched | |

FIG. 10

172

AC Feed Forward

Rephasing of belt home signal to start of compensation table

Case A: The number of Belt zones is greater than the number of table zones (i.e. Went through the table too fast")

Correction next rev occurs at:
zones 337, 674, 1011, 1348

Since the belt has more zones than the table, at the appropriate belt zones determined above, the table correction is not applied, effectively shifting the compensation table down, such that the end of the compensation matches the end of the belt zones.

180

AC Table Phasing example

| Table location | Value | | Belt Zone |
|---|---|---|---|
| | | Previous Home sensor signal | |
| 1 | 1 | | 1 |
| 2 | 0 | | 2 |
| 3 | −1 | | 3 |
| . | . | | . |
| . | . | | . |
| 1687 | 1 | Case B Sensor signal | 1687 |
| 1688 | 0 | | 1688 |
| 1689 | 1 | Last zone used =2 | 1 |
| 1690 | 0 | Went thru table "Too slowly" | 2 |
| 1 | 1 | | 3 |
| 2 | 0 | | 4 |
| 3 | −1 | | |
| 4 | 0 | | |

Desired position

AC Feed Forward

Rephasing of belt home signal to start of compensation table

Case B: The number of Belt zones is less than the number of table zones (i.e. "Went through the table too slowly")

Table_Zones = 1690
Last_Zone_Used = 1688
Belt_zones_per_rev = 1688

Table size correction =Table_Zones − Belt_zones_per_rev
= 1690 − 1688 = 2

Position correction =Table_Zones − Last_Zone_Used
= 1690 − 1688 = 2

Total Correction =Table_size_correction + Position_correction
= 2 + 2 = 4

Correction Interval =[Belt_zones_per_rev/( |Total correction| + 1)] −1
=1692/(|−4| + 1) − 1 = 337.4==>337

FIG. 11

182

AC Table Phasing example

| Table location | Value | | Belt Zone |
|---|---|---|---|
| 1687 | 1 | Previous | 1687 |
| 1688 | 0 | Home | 1688 |
| 1689 | 1 | sensor | 1 |
| 1690 | 0 | signal | 2 |
| 1 | 1 | | 3 |
| . | . | | . |
| . | . | Correction #1 | . |
| 334 | 0 | at belt zone 337 | 336 |
| 335 | 1 | two corrections | 337 |
| 336 | 1 | are made and | -- |
| 337 | 1 | the compensation | 338 |
| . | . | table is shifted up | . |
| . | . | | . |
| | | Correction #2 | |
| 672 | 0 | at belt zone 674 | 673 |
| 673 | 1 | two corrections | 674 |
| 674 | 1 | are made and | -- |
| 675 | 1 | the compensation | 675 |
| . | . | table is shifted up | . |
| . | . | | . |
| | | Correction #3 | |
| 1010 | 0 | at belt zone 1011 | 1010 |
| 1011 | 1 | two corrections | 1011 |
| 1012 | 1 | are made and | -- |
| 1013 | 1 | the compensation | 1012 |
| . | . | table is shifted up | . |
| . | . | | . |
| | | Correction #4 | |
| 1348 | 0 | at belt zone 1348 | 1347 |
| 1349 | 1 | two corrections | 1348 |
| 1350 | 1 | are made and | -- |
| 1351 | 1 | the compensation | 1349 |
| . | . | table is shifted up | . |
| . | . | | . |
| 1688 | 0 | | 1686 |
| 1689 | 1 | | 1687 |
| 1690 | 0 | Sensor signal | 1688 |
| 1 | 1 | Last zone used | 2 |
| 2 | 0 | =1690 | 3 |
| 3 | -1 | Belt and table matched | 4 |

FIG. 12

AC Feed Forward

Rephasing of belt home signal to start of compensation table

Case B; The number of Belt zones is less than the number of table zones (i.e. "Went through the table too slowly")

Correction next rev occurs at:
zones 337, 674, 1011, 1348

Since the belt has less zones than the table, at the proper belt zone determined above, the correction from two zones is applied simultaneously, effectively shifting the compensation table up, such that the end of the compensation matches the end of the belt zones.

METHOD AND APPARATUS FOR CONTROLLING TRANSFER BELT VELOCITY OF A COLOR PRINTER

TECHNICAL FIELD

The present invention relates generally to image forming equipment and is particularly directed to color laser printers of the type which have transfer belts that receive latent images from multiple photoconductive members. The invention is specifically disclosed as a motion control system that maintains a substantially constant belt velocity under varying environmental conditions and for various styles of drive motors and variations in individual belt physical parameters.

BACKGROUND OF THE INVENTION

In color printers a plurality of color planes are sequentially aligned and deposited onto a transfer media such as a transfer belt. The transfer belt is then used to transfer the accumulated color planes to a piece of paper or other media. A problem associated with this process is misregistration or misalignment of one or more of the color planes. Alignment of the color planes is crucial in achieving a high quality image. Due to the fact that each individual color plane is transferred onto the belt or paper at different locations along the travel path of the transfer belt, the belt position within the travel path must be controlled with a high degree of precision. The motion of the drive motor that drives the belt must be accurately controlled to insure that there is little or no misregistration of the color planes on the belt such that the resulting image is of good quality.

There are many instances where motion inaccuracy can develop and cause a concomitant degradation in the resulting image. Factors such as variations in the thickness of the belt, variations in the belt tension, and variations in the drive motor system itself are examples of factors that lead to motion inaccuracy.

Motor control systems of color printers usually sense motor position by means of an encoder and control the motor driver such that pulses produced by the encoder coincide with clock pulses generated by the controller. This adds cost and complexity to the printer. It would be desirable to have a method and apparatus that corrects for motion inaccuracy which is inexpensive to implement and does not add complexity to the printer.

SUMMARY OF THE INVENTION

A transfer belt subassembly for a color printer includes a transfer belt, a home position indicator, a temperature sensor and a memory. The transfer belt subassembly is measured and characterized after its fabrication and before being installed in a printer. The measurement and calibration data for the transfer belt is stored in the memory that is part of the subassembly. The memory stores data representing the motion characteristics of the transfer belt, such as velocity characteristics and temperature compensation factors for use by an engine-controller (which may be defined as one or more integrated circuits, including a microprocessor or logic state machine, firmware, and memory) of the printer to govern the motion control of the drive motor. When the transfer belt subassembly is inserted into a printer, the engine-controller in the printer is placed in communication with the memory. Sensors are employed to determine the home position of the transfer belt and to provide a measure of belt velocity and temperature. The engine-controller utilizes the characterizing data from the memory and temperature sensor data (such as the output of a thermistor) to provide adjustment of belt velocity and compensation for variations in the transfer belt motion quality. By use of the predetermined characterizing data, precise alignment of the color planes with respect to one another is achieved for accurate color printing.

In one embodiment, two belt sensors are used for velocity control of the belt. In another embodiment, only a single belt sensor is used for belt velocity control. In both preferred embodiments, a temperature sensor is used to correct for temperature variations that can affect the physical characteristics of the belt.

It is an advantage of the present invention to provide a motion control system that controls the velocity of a moving belt member of an electrophotographic printer, while correcting for variations in environmental conditions or variations in individual belt parameters.

Additional advantages and other novel features of the invention will be set forth in part in the description that follows and in part will become apparent to those skilled in the art upon examination of the following or may be learned with the practice of the invention.

To achieve the foregoing and other advantages, and in accordance with one aspect of the present invention, an apparatus for providing transfer quality optimization of color planes transferred to or from a transfer belt of an image forming apparatus is provided, which comprises: a plurality of transfer rollers; a transfer belt disposed about the plurality of transfer rollers; a memory capable of storing data relating to the transfer belt at multiple transfer stations; a home position indicator associated with the transfer belt; first and second sensors for sensing the home position indicator; and a temperature sensor for sensing temperature near a surface of the transfer belt.

In accordance with another aspect of the present invention, an apparatus for providing transfer belt position correction, used in a color printer having a plurality of color planes deposited onto a transfer belt, comprises: a transfer belt subassembly including: (a) a transfer belt disposed about a plurality of rollers and having a home position indicator; (b) a temperature sensor disposed to sense temperature near a surface of the transfer belt and to provide a signal representative thereof; and (c) a memory capable of storing transfer belt calibration data.

In accordance with a further aspect of the present invention, a method of controlling transfer belt position in a color printer is provided, in which the color printer has a plurality of color stations, a transfer belt subassembly having a transfer belt disposed about a plurality of rollers, a temperature sensor, a belt position sensor, a memory, and a variable speed motor for driving the transfer belt about the rollers, the method comprising: storing characterizing data for the transfer belt in the memory which represents the measured velocity profile for the transfer belt; and providing drive signals to the variable speed motor in response to data from the memory and signals from the sensors to control the speed of the motor and the speed of the transfer belt to provide nearly constant surface velocity between color stations of the printer.

In accordance with still a further aspect of the present invention, a printer having a motion-controlled transfer belt is provided, comprising: a plurality of rollers; a transfer belt disposed about the plurality of rollers; an indicator disposed on the transfer belt; a plurality of sensors disposed adjacent the transfer belt, each of the plurality of sensors capable of sensing the indicator; a memory for storing data representing transfer belt characteristics; a motor for driving the transfer belt; and a controller in communication with the plurality of sensors, the memory and the motor, the controller operative to adjust the speed of the motor in accordance with the contents of the memory to compensate for motion inaccuracy of the transfer belt based on the velocity profile of the transfer belt.

In accordance with yet another aspect of the present invention, an image forming apparatus having a motion-controlled transfer belt is provided, comprising: a plurality of rollers; a transfer belt disposed about the plurality of rollers; an indicator disposed on the transfer belt; a sensor disposed adjacent the transfer belt, for sensing the indicator; a memory for storing data representing transfer belt characteristics; a motor for driving the transfer belt; a controller in communication with the sensor, the memory, and the motor, the controller operative to run the transfer belt at a predetermined default motor speed for an entire belt revolution, as detected by the position sensor; and the controller being further operative to count motor output pulses during the belt revolution, and to adjust the belt speed accordingly to run at a substantially constant velocity.

Still other advantages of the present invention will become apparent to those skilled in this art from the following description and drawings wherein there is described and shown a preferred embodiment of this invention in one of the best modes contemplated for carrying out the invention. As will be realized, the invention is capable of other different embodiments, and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification illustrate several aspects of the present invention, and together with the description and claims serve to explain the principles of the invention. In the drawings:

FIG. 9 is a diagrammatic view of an AC feedforward control example in which the number of belt zones is greater than the number of table zones;

FIG. 10 is a diagrammatic view of an AC feedforward control example with appropriate corrections under the control of the present invention, in which the number of belt zones is greater than the number of table zones;

FIG. 11 is a diagrammatic view of an AC feedforward control example in which the number of belt zones is less than the number of table zones;

FIG. 12 is a diagrammatic view of an AC feedforward control example with appropriate corrections under the control of the present invention, in which the number of belt zones is less than the number of table zones.

DETAILED DESCRIPTION OF THE PREFERRED EMBODIMENT

Reference will now be made in detail to the present preferred embodiment of the invention, an example of which is illustrated in the accompanying drawings, wherein like numerals indicate the same elements throughout the views.

Figure 1:
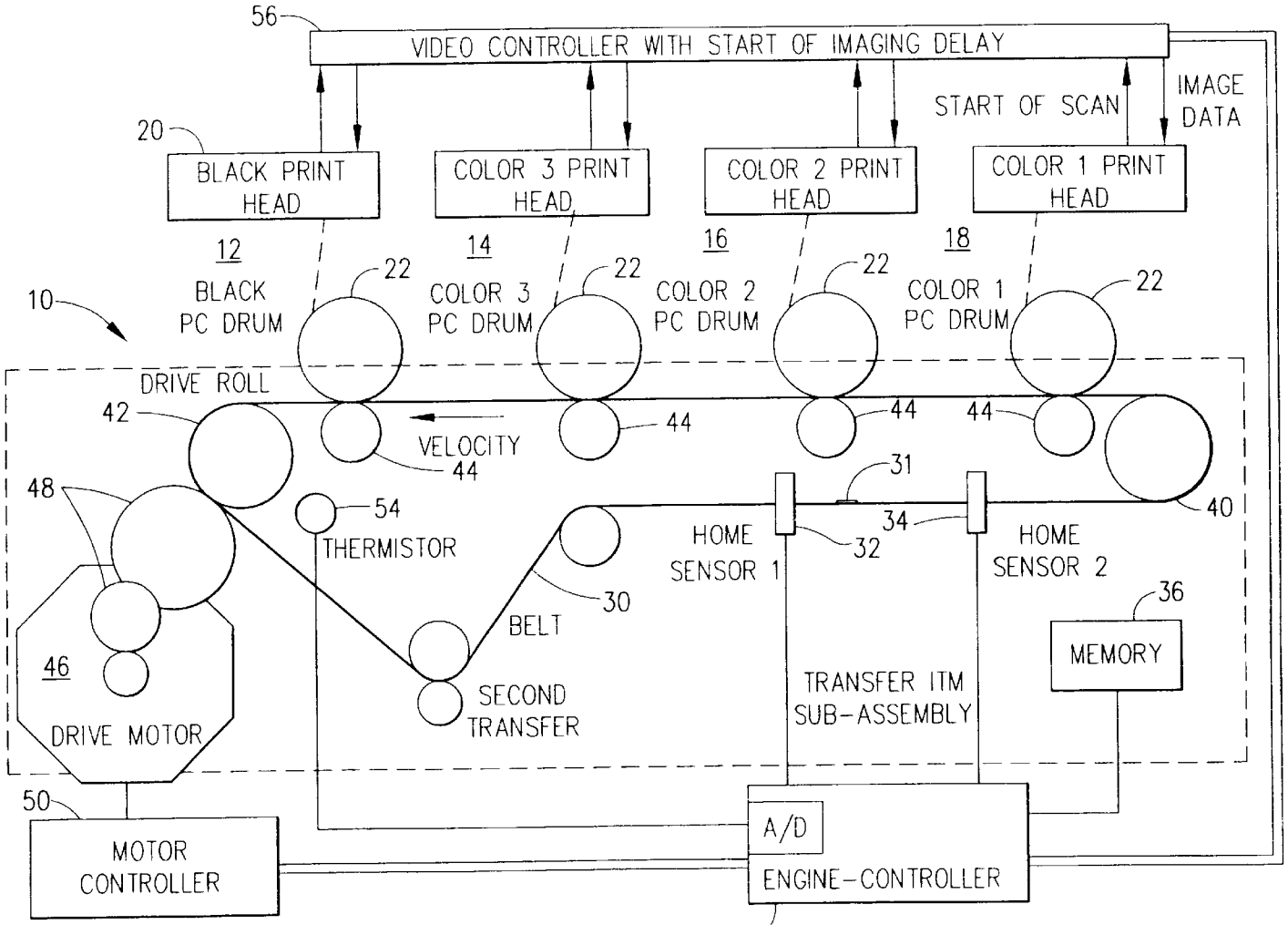
FIG. 1 is a diagrammatic view illustrating the apparatus of the present invention.

Referring now to the drawings, FIG. 1 shows a transfer belt subassembly 10 and color stations 12, 14, 16 and 18 each associated with a respective color plane. In the illustrated embodiment station 12 is utilized for providing a black color plane, and stations 14, 16, and 18 respectively provide the primary color planes cyan, magenta and yellow. Each of the color stations includes a print head 20 and a PC drum 22. The print head forms a latent image on the associated PC drum and toner is supplied to the PC drum and the developer assembly produces a developed toned image, also known as a color plane, from the latent image on the PC drum. Each color station may be realized through any one of a plurality of known configurations.

The transfer belt subassembly 10 contains a transfer belt 30, a first home position sensor 32, a second home position sensor 34 (in some embodiments), a thermistor 54 and a memory 36. The sensors are typically optical sensors which are cooperative with one or more reference holes or indicia in the belt, as will be described. A reference indicia in the illustrated embodiment is provided by a hole in the transfer belt which is sensed by electro-optical sensors 32 and 34. The indicia can be of other types such as magnetic or electrostatic marks, or reflective surfaces on the belt sensed by appropriate sensors (e.g., magnetic, electrical charge, or optical sensors). The memory 36 is preferably a semiconductor memory such as a non-volatile memory.

The transfer belt 30 is supported on a plurality of rollers including an end or tension roller 40 and a drive roller 42. Transfer rollers 44 are associated with respective PC drums 22. A drive motor 46 drives the drive roll 42 through a series of intermediate gears or rollers 48, and the drive motor is governed by motor controller 50. An engine-controller 52 is coupled as shown to the motor controller 50, sensors 32 and 34, memory 36 and thermistor 54. The engine-controller 52 is also coupled to a video controller 56 which receives signals from the respective print heads 20 and provides image data signals thereto.

The drive motor 46 can be a brushless DC motor in one embodiment. The speed of the motor is controlled by driving signals from the motor controller wherein each pulse of the drive signal represents a desired angular displacement of the motor. In an alternative embodiment, the motor can be a stepper motor in which each pulse represents an angular displacement of the motor. The period of consecutive pulses determines motor shaft velocity.

After fabrication of subassembly 10, belt surface velocity measurements are made using a test fixture having a precision encoder wheel that engages a linear section of the belt surface near the drive roll, and which includes standard interface elements like those in a printer. The interface elements are usually the photoconductor drums. In the preferred embodiment, velocity measurements are derived from a multi-pass average of belt velocity using a home indicia on the belt at sensor location 2, sensed by sensor 34, as a circumferential position reference. The averaged velocity data is notch filtered to remove components of velocity corresponding to the drum roll circumference and the measurement wheel circumference, and is then low pass filtered to remove high frequency components corresponding to gear tooth frequency and noise. The break point on the low pass filter is nominally chosen to clip components with periods less than 100 mm. Dependent on belt, drive roll and idler roll characteristics, the low pass frequency break point could range from about ¼ to 1/20 times the belt circumference. For an 889 mm belt circumference, the range would be about 44 mm to 222 mm. The AC motor positional profile required to drive the belt at constant surface velocity is derived from the measured/averaged/filtered/integrated/inverted velocity data and is recorded in encoded form into the memory 36 in the subassembly. The memory 36 contains a correlation factor which relates the required velocity adjustment setting to a change in the temperature, with respect to a reference temperature (e.g., 23 degrees C.). The memory 36 also contains the motor setpoint value which is applicable at a reference temperature (e.g., 23 degrees C.). The motor setpoint value sets the nominal drive reference frequency for a brush DC motor with associated encoder or a brushless DC motor with internal speed control, or the step rate for a stepper motor.

In an alternate (or second preferred) embodiment, the memory 36 also contains data on the time between home sensors 32 and 34 to achieve a known belt surface velocity at a known temperature, with and without AC feed forward velocity control, temperature compensation factor for time between sensors at other temperatures, and belt length in zones corresponding to the length of the velocity correction table.

Thus, the subassembly 10 after its manufacture and before installation in a printer for use, has characterizing data stored within an internal memory which is part of the subassembly. When the subassembly is installed in an associated printer, the characterizing data in memory 36 is employed by engine-controller 52 of the printer to govern feed forward velocity control for accurate registration of color planes for accurate color printer operation.

Figure 2:
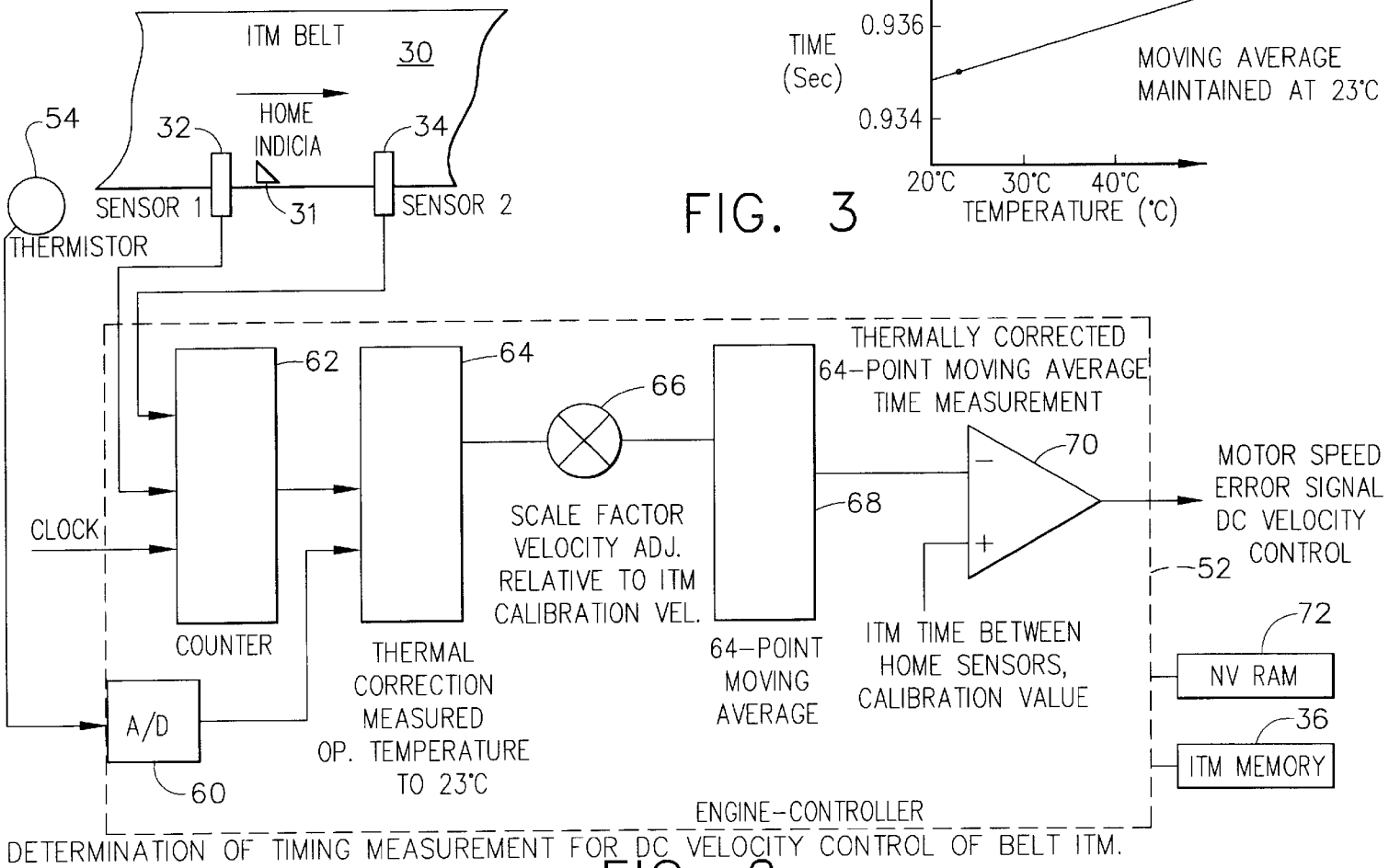
FIG. 2 is a schematic block diagram illustrating DC velocity control in accordance with the invention.

The operation of engine-controller 52 to provide DC correction will be described in conjunction with FIGS. 2 and 13. A thermistor 54 preferably located near the surface of belt 30 at the drive roll provides a resistance which is converted to a voltage representative of sensed temperature and which is provided to an A/D (analog-to-digital) converter 60 which is part of engine-controller 52. This thermistor signal is representative of average drive roll temperature. The thermistor may alternatively be located in contact with the belt near the drive roll or in contact with the drive roll itself. On FIG. 13, after running through an A/D converter (not shown), the thermistor signal value (e.g., a numeric value of 223) arrives on line 212 to a difference stage 210. A thermistor reference value (for a predetermined nominal operating temperature) is stored in system memory, and also has a numeric value (such as 236) that is scaled to correspond to the thermistor input signal value 212. The output from the difference stage 210 is the signal at 216, and in the above example it would have a numeric value of −13.

Figure 13:
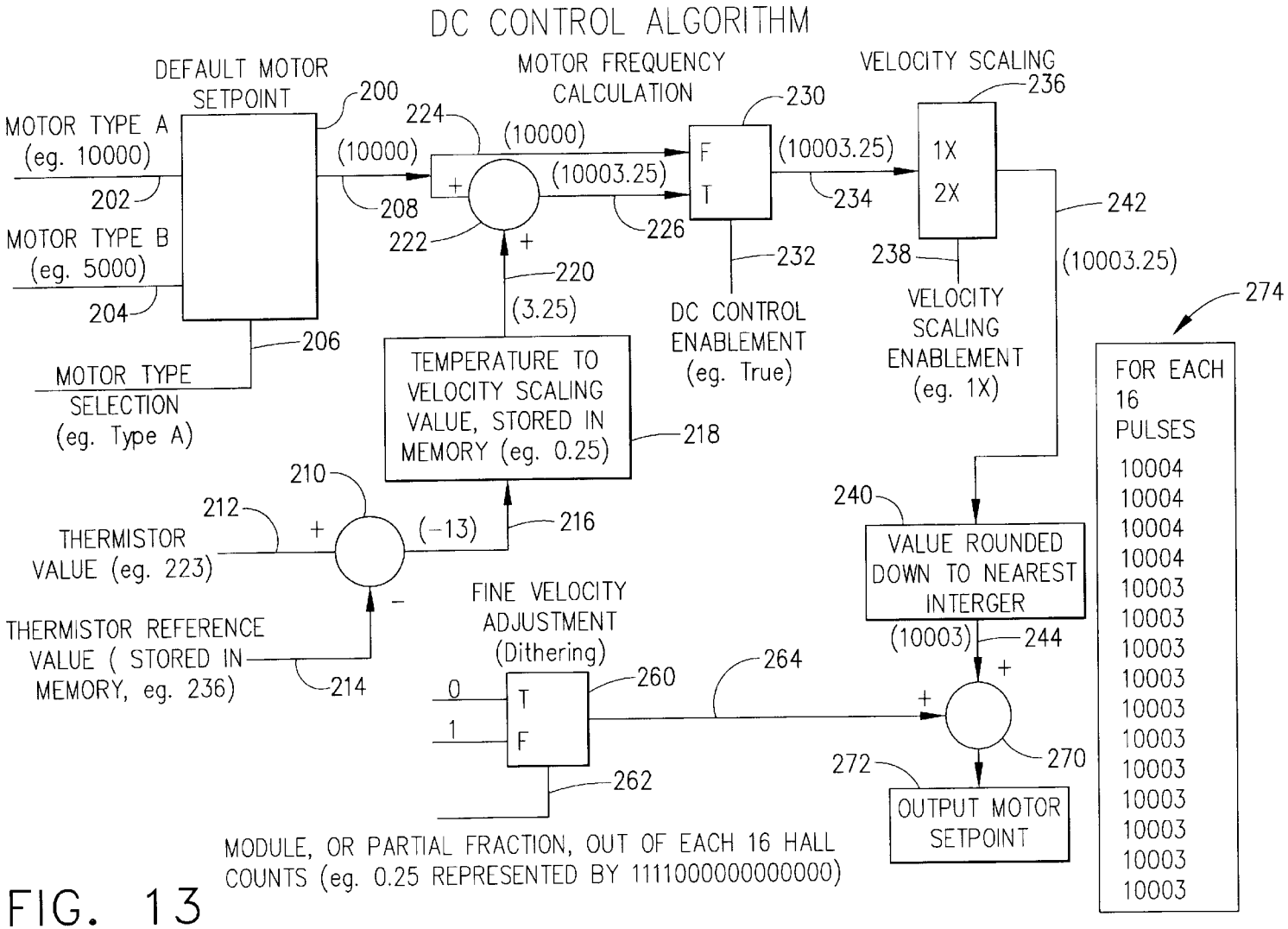
FIG. 13 is a block diagram of a DC control algorithm used in one embodiment of the present invention, in which the output motor control signal is adjusted to compensate for temperature effects.

The relationship between a change in temperature and a change in belt velocity is empirically determined and stored in the memory 36 (i.e., the "scaling factor" at memory table 218 on FIG. 13). This velocity-to-temperature conversion represents a scaling value that converts the temperature difference value to an adjustment value of the motor frequency. The output 220 from the memory table 218 for the example of FIG. 13 is a numeric value of 3.25, because the value read from the memory table 218 was equal to −0.25, which when multiplied by −13 gives a product of +3.25.

The memory 36 also contains the motor setpoint value at a reference temperature (e.g., 23 degrees C.). Several motor types or manufacturers may be supported, which requires that the motor setpoint value for each motor type be also be stored in memory 36, as well as the velocity-to-temperature conversion value for each motor type.

Prior to printing, the engine-controller 52 will interrogate the motor for type, and download the appropriate motor setpoint value, and velocity-to-temperature scaling value into NVRAM 72. A default motor setpoint is determined at a register or memory cell 200 (see FIG. 13) that acts as a logical multiplexer by selecting a value for either "motor type A" or "motor type B." The value for motor type A is, e.g., 10000, on line 202, while the value for motor type B is, e.g., 5000, on line 204. The selection at line 206 is choosing motor type A in the example of FIG. 13, and logical multiplexer 200 accordingly outputs a value of 10000 on line 208, which represents a desired period of the reference clock that drives the motor which drives the belt.

The engine-controller 52 will also poll the ITM memory 36, to determine whether the DC control algorithm should be enabled, as determined at a logic stage 230, controlled by a virtual signal 232. It will be understood that the circuit diagram depicted on FIG. 13 could either be implemented in hard logic (such as in an ASIC), or could be implemented using a microprocessor with sequential logic, or by a logic state machine. If the DC control algorithm is turned OFF, then the value at a signal line 224 (from logic stage 200) will pass through the logical multiplexer 230 to be input at 234 to the next logic stage 236. This mode is not a typical use of the circuit or control logic of the preferred DC control algorithm, although it is useful for debugging the control software used to implement this algorithm. On the other hand, if the DC control algorithm is turned ON, then the value at a signal line 226 will pass through the logical multiplexer 230 to be input at 234 to the next logic stage 236.

As the system is operating, with the DC control enabled, the digitized temperature information from thermistor 54 is supplied to circuit 210, which is then compared against the reference value. This error will be multiplied by the velocity-to-temperature conversion value stored at 218. The output of this calculation will be added to the motor setpoint value at an adder stage 222, to give the thermally compensated motor setpoint at 226 (as noted above). In this manner, the thermal expansion of the drive roll may be compensated, providing a stable thermally corrected belt velocity. In the example of FIG. 13, the compensation value (or "correction value," or "adjustment value") at 220 was 3.25, which when added to the value of 10000 at the signal line 208 gives a new "compensated" value of 10003.25, which is input at the "true" input of the logical multiplexer 230.

The motor setpoint output may be further scaled at a mathematical function block 236 by a factor which compensates for intended change in belt velocity relative to the calibration velocity which can occur, for example, as a result of page length adjustment or to run the process at half speed or some other predetermined speed. This choice could be made available to the printer's user, or it could be automatic when printing at a finer or coarser print resolution (e.g., 600 dpi or 1200 dpi), or when printing on certain types of print media. For example, if printing on a transparency sheet, the printing speed could be slowed down to half speed by the velocity scaling function at block 238, as selected by a select signal or flag bit at 238.

On the example of FIG. 13, the velocity value at 242 was not scaled, and so the value remained at 10003.25, which represents a desired period value for the reference clock. To remove extraneous noise and create a stable system, low pass filtering may be applied to the digitized temperature information.

A mathematical function stage 240 now rounds the value at 242 down to the nearest integer, which in this example of FIG. 13 outputs a numeric value of 10003 at 244. This value at 244 is summed at an adder circuit or logic stage 270 with a "fine velocity adjustment" value at a line 264, which is derived from a dithered virtual multiplexer stage 260. As clock pulses are sent to the drive motor 46, the pulse duration of each of the output pulses is preferably controlled by a pulse width modulator (i.e., at the output of the "output motor setpoint" stage 272 on FIG. 13). The stage 260 can output either a Logic 0 or a Logic 1 to the adder circuit/stage 270, under the control of an input signal line (or software function) at 262. If a Logic 1 is output to the adder circuit/stage 270, then the signal value is incremented, so that the signal value at 272 is one step greater than the signal value at 244. In this example, the signal value increments from 10003 to 10004, as indicated by the table 274 on FIG. 13.

The dithering effect is determined by the numeric value that was lopped off at the stage 240, when the signal was converted to an integer. In the example on FIG. 13, a value of 0.25 was eliminated. Therefore, the dithering effect of circuit 260 has compensated for this by causing four (4) of the next sixteen (16) clock pulses to be incremented, thereby effectively adding a value of 4 parts in 16 (0.25) to the output motor setpoint 272.

In the first preferred embodiment, a PC drum spacing of 303 mm from the "color1 PC drum" 22 (e.g., Yellow) to Black transfer stations, along the path of the ITM with an adjustment resolution of 1 part in 10,000 (0.01%), of the nominal motor reference period, would provide a registration adjustment of 0.030 mm between the first and last color stations.

This 0.01% adjustment in motor velocity is accomplished by stretching or reducing the reference clock period by 100 nanoseconds for the nominal 1 millisecond reference period. This resolution of adjustment is inadequate for a tandem color printer, and would preferably have an adjustment of resolution of at least 1 part in 100,000 (0.001%).

By dithering the motor reference period (at adder stage 270) between two adjacent reference period values over a predetermined period, thereby creating an effective PWM (pulse width modulation) signal, the average belt velocity may be adjusted to a much higher resolution. In this manner, the edges of the motor encoder reference signal may be used as the PWM period. In the preferred embodiment, the PWM period may last for 8 full encoder periods, giving 16 edges for possible dithering of the reference frequency, which would increase the DC adjustment resolution by a factor of 16.

In the alternative embodiment of the present invention, the dual optical sensors 32 and 34 are placed at a spaced relationship substantially equal to the circumference of the drive roll 42 after adding ½ of the belt thickness to the roller radius. The resultant time delay measured as the home indicia 31 on the belt moves from one sensor to the next, provides a time delay representative of the average belt velocity. The effective drive roll circumference is also nominally equal to the spacing between PC drums to null out drive roll runout effects.

Figure 3:
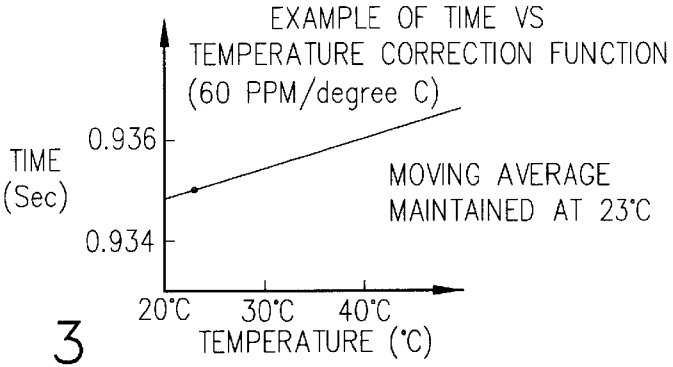
FIG. 3 is a plot of time vs. temperature and useful in describing the operation of the apparatus of FIG. 2.

A thermistor 54 preferably located near the surface of belt 30 at the drive roll provides a resistance which is converted to a voltage representative of sensed temperature and which is provided to an A/D converter 60 which is part of engine-controller 52. This thermistor signal is representative of average drive roll temperature. The thermistor may alternatively be located in contact with the belt near the drive roll or in contact with the drive roll itself. The relationship between temperature and time for the home indicia to pass between sensors corresponding to maintaining a consistent process direction registration between the Black PC drum of print station 22 and color print PC drums of print stations 14, 16, 18 is empirically determined and stored in memory 36. This correction function is used in conjunction with the measured temperature to thermally correct the measured time difference. FIG. 3 shows a graph of a time vs. temperature correction function.

The operation of engine-controller 52 to provide DC correction will be described in conjunction with FIG. 2. A moving average of the differential time measurements from the sensors 32 and 34 with compensation for expected thermal expansion for the drive roll and thermal expansion of the belt between stations provides a stable thermally corrected measurement of time delay between stations. The sensor signals are applied to a counter 62, the output of which is applied to thermal correction circuit 64 which provides the temperature correction function as shown in the graph of FIG. 3. The digitized temperature information from thermistor 54 is supplied to circuit 64 which provides an output scaled by a scale factor circuit 66 which compensates for any intended change in belt velocity relative to the calibration velocity which can occur, for example, as a result of page length adjustment or to run the process at half speed or some other predetermined speed. After scaling the signal is applied to a moving average circuit 68.

The thermally corrected and averaged time measurement is compared to a calibration time between sensors to achieve a predetermined velocity at a fixed temperature. The calibration time is retrieved from the memory 36. The difference value upon subtraction at 70 provides an error signal which serves as an error signal for DC velocity control. This error signal sets the nominal drive reference frequency for a brush DC motor with associated encoder or a brushless DC motor with internal speed control, or the step rate for a stepper motor. When the error signal is driven to zero, the thermally corrected average drive velocity results in constant time delays from PC drum to PC drum that avoid DC color plane misregistration that would otherwise result from changes in DC time delay caused by temperature variations.

The current value of the moving average is maintained by the engine-controller 52 in NVRAM 72. This value is maintained after correction to 30° C. and corresponds to the belt calibration process speed. When a new subassembly is installed into the printer, as usually recognizable by a unique serial number stored in memory 36, the NVRAM 72 moving average is reinitialized to the calibration value for the newly installed subassembly.

The moving average preferably comprises 64 measurements for computational simplicity. Errant measured values, typically more than 2% from the current moving average, are discarded prior to averaging.

In the alternative preferred embodiment, the moving average is obtained by multiplying the current average time delay by 63/64 and adding in 1/64 times the new measurement. However, other averaging techniques can also be used including a 64-element running average with or without weighting of the buffered values. The 64 elements corresponds to a physical thermal time constant for a desktop printer (8.37 minutes) over which a DC velocity change will occur. Greater or fewer elements can be included in the average, although the choice of a power of two allows calculation of the average by shifting and adding rather than by multiplying and dividing.

Because the time difference between sensors is determined on a continuing basis during printing, the AC velocity feed forward correction, which will be described below, should be enabled during this time measurement and compared to the calibration value with the AC feed forward enabled. If the AC feed forward is not enabled, the calibration value without AC feed forward should be used.

In the preferred embodiment, the initial DC time difference value stored in memory 36 is used in conjunction with the drive roll temperature measurement to determine the motor reference frequency or step rate. This preferred implementation saves the cost of a second belt home sensor but loses the function of tracking and correcting velocity changes over the life of the subassembly.

For "AC correction" (i.e., the motion errors due to belt thickness variations, which are substantially consistent between belt revolutions) the engine-controller 52 retrieves the velocity profile data from memory 36 and which is used to vary the motor reference period to achieve constant surface velocity at the drive roll position of the belt. The home index 31, which may be a hole, or other indicia painted or placed on or in the belt 30, is used in conjunction with the second sensor 34 to establish a home reference position for the position correction algorithm. The AC error correction signal supplied to the drive motor results in nearly constant surface velocity between color stations in a pipeline color EP printer, ignoring the drive roller once around contribution to velocity variation and higher frequency gear jitter and noise components. The speed control results in fixed time delays between stations that do not vary in an AC sense with belt position relative to a home sensor. Thus, the AC component of color plane misregistration is substantially minimized.

The belt drive is controlled to provide constant and predictable belt travel from print station to print station within a tolerable error which is nominally 50 $\mu$m or less. Ideally the system is controllable in increments of 10% or less of the tolerable error (5 $\mu$m) and thus the frequency of updates is chosen so that the change in motor velocity corresponds to one controllable increment.

In the preferred embodiment, a belt with 889 mm circumference is segmented into 1690 zones with a zone length of approximately 0.53 mm. The zone length may be determined using the motor output encoder, which may be a magnetic Hall device, or similar type. Each zone has a two bit representation of the sequential change in drive motor reference period corresponding to zero, plus 0.01%, or minus 0.01% that is required to correct the drive motion to achieve nearly constant belt surface velocity. A 0.01% change is actually accomplished by stretching or reducing the reference clock period by 127 nanoseconds for the nominal 1270 microsecond reference clock. In a preferred embodiment, the minimum integrated position correction increment over a 101 mm station spacing is approximately 0.1 $\mu$m; the maximum integrated position correction achievable over a 101 mm station spacing is about 970 $\mu$m; and the maximum rate of velocity change is about 0.02% per mm. Alternate embodiments may use motors with a different number of Hall pulses per revolution of the motor, and consequently there may be alternative number of zones per belt, with an alternative zone duration.

For continuity in velocity control from home detect to home detect, variation in belt length as a result of temperature and stretch over life needs to be accommodated. Without compensation, the zone counter which points to the current velocity correction value in the memory table could lose synchronization to the home indicia on the belt due both to changes in belt length and to accumulated velocity errors. The velocity changes by zone summed over the table must total to zero to avoid a net velocity change in one revolution of the belt. To avoid changing the DC velocity of the belt, the integrated area under the positional adjustment curve must also sum to zero. For this reason, an AC_Offset value (see step 122 on FIG. 7) needs to be incorporated when the AC control algorithm is initially activated. This AC_Offset value is described graphically in FIG. 6. The AC_Offset value is stored in memory 36. In order to avoid discontinuities, a zone counter must index through the table continuously without premature reset and without counting past the end of the table. The length of the correction table in zones is stored in the memory 36 at the time of calibration of the subassembly.

Figure 6:
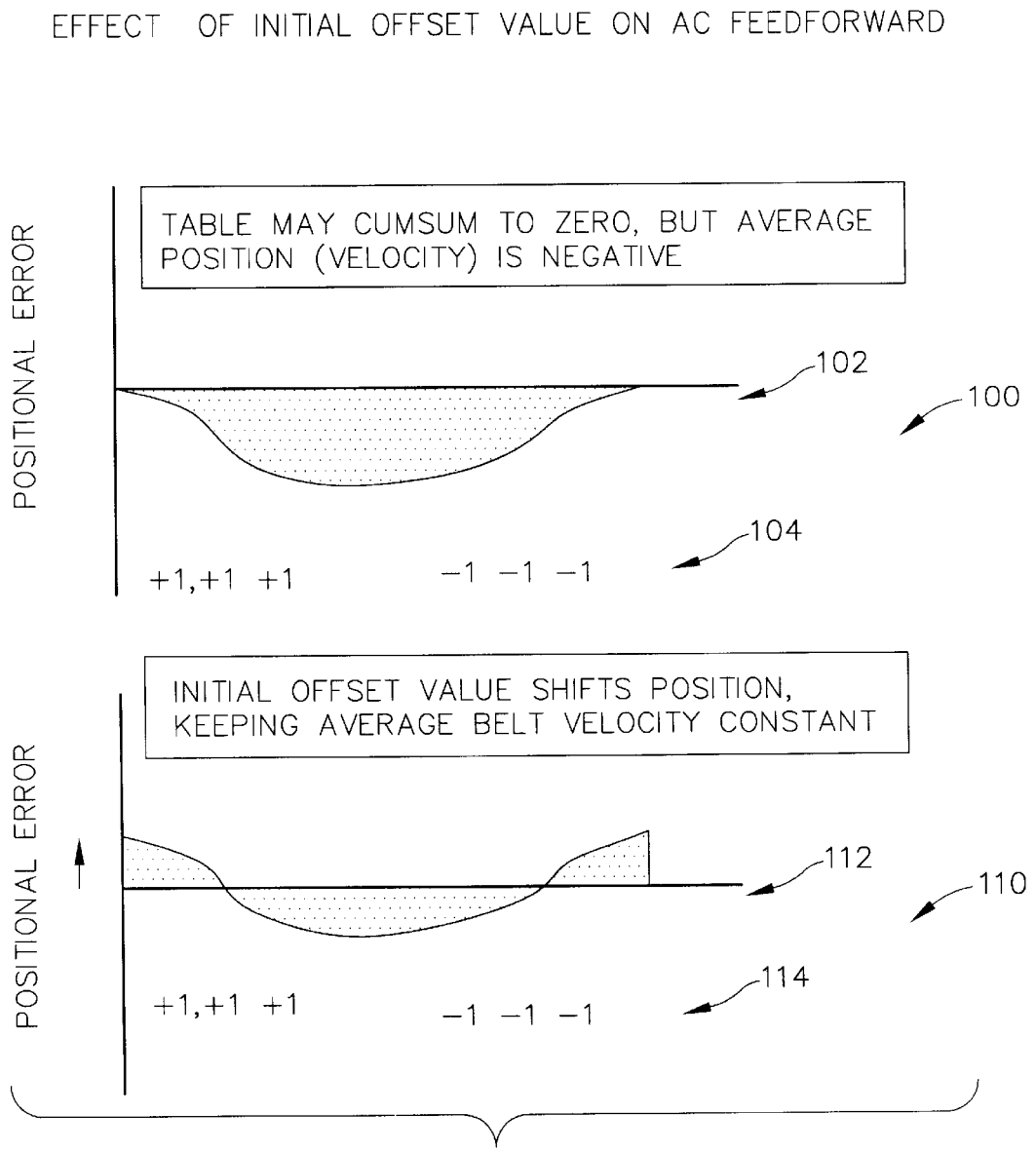
FIG. 6 are plots of belt positional error vs. AC feedforward commands over a belt revolution, one plot having an initial offset value applied.

On FIG. 6, the top graph 100 represents a curve 102 of the positional errors over a single revolution of the belt, while position corrections are periodically being input (at 104). The curve 102 is always negative with respect to the X-axis, and therefore, an error accumulates, as represented by the area "under" the curve (i.e., the integral of the curve's function). The bottom graph 110 represents a curve 112 having a similar shape (due to the same position corrections at 114, however, an initial offset value has been added to the curve so that its integral is substantially zero (0) from the first home position to the next.

Figure 7:
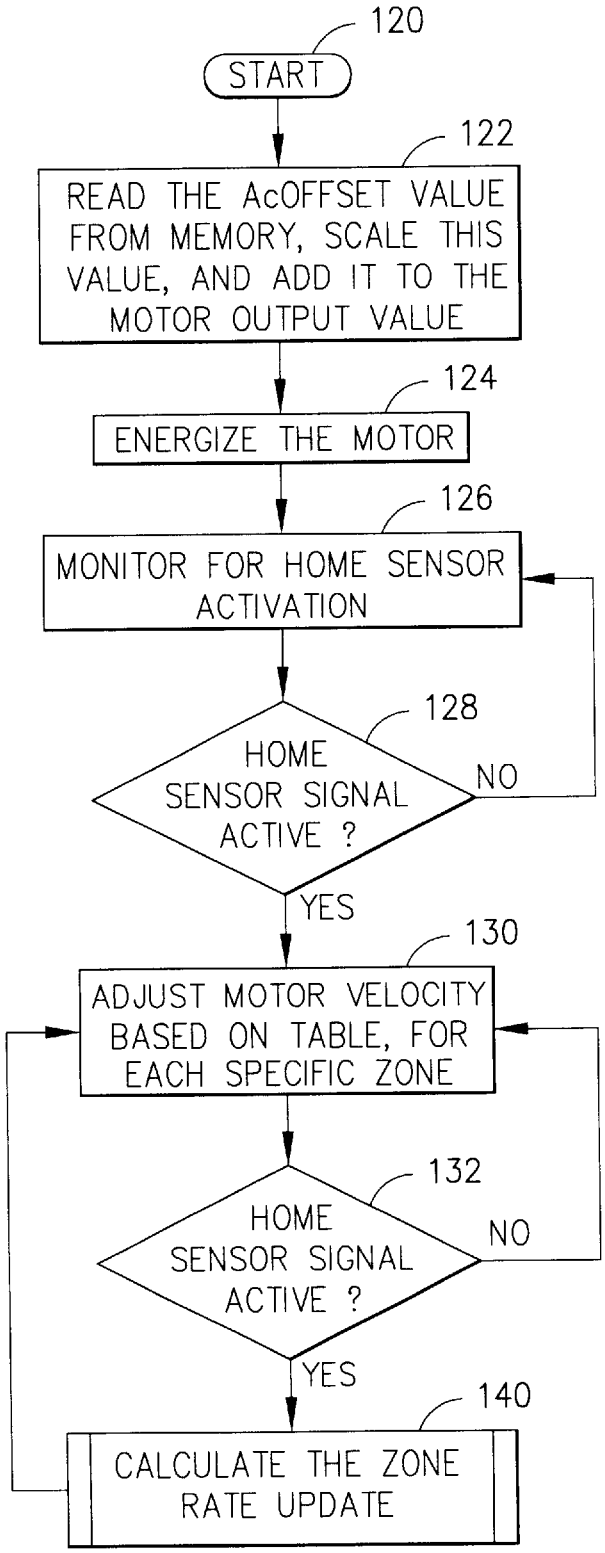
FIG. 7 is a flow chart of some of the important logical steps involving the AC feedforward control functions of one embodiment of the present invention.
Figure 8:
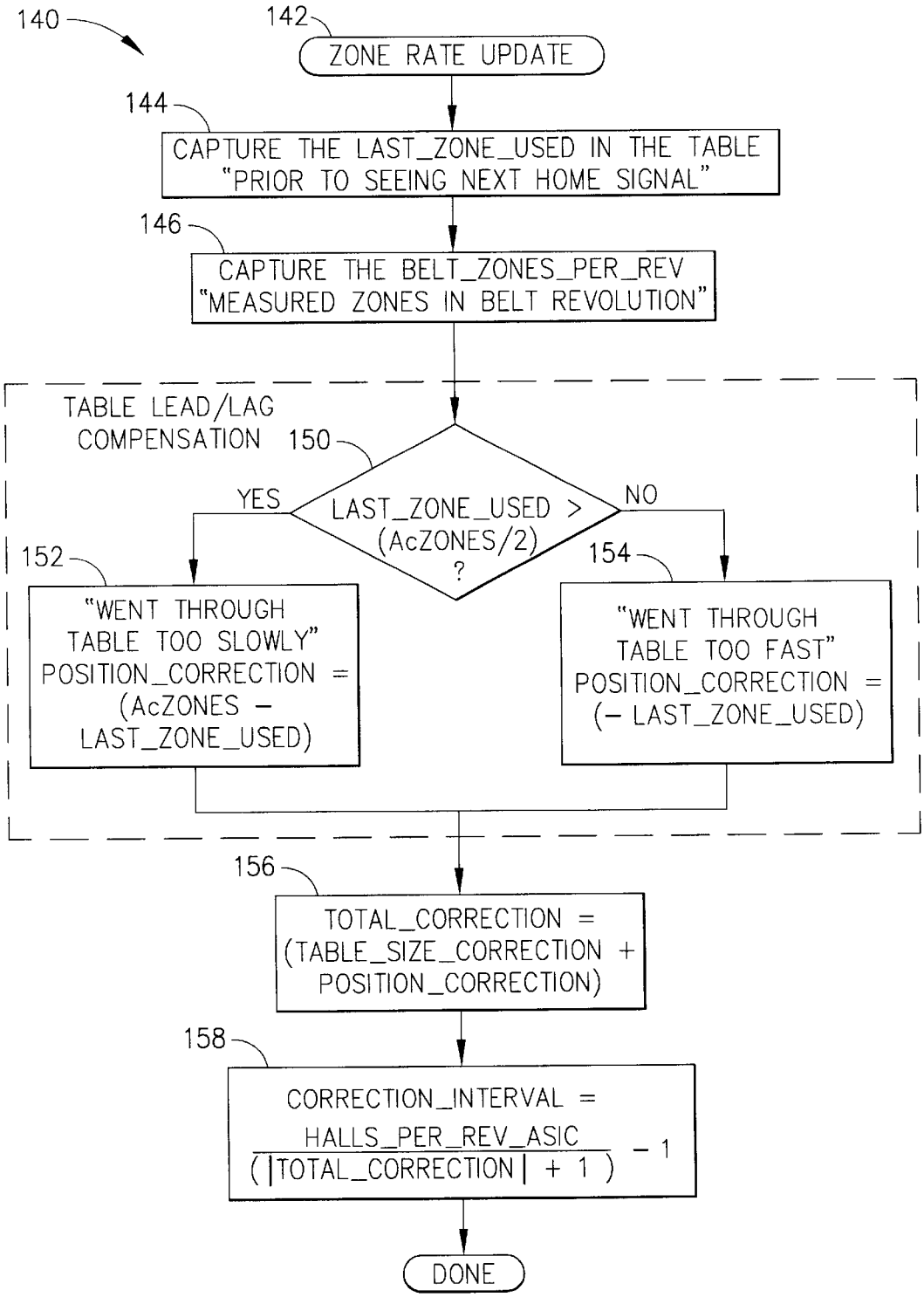
FIG. 8 is a flow chart of some of the important steps involving the zone rate update function of the flow chart of FIG. 7.

The engine-controller algorithm that maintains synchronization of the zone counter and velocity correction table relative to the belt home indicia is depicted in FIGS. 7 and 8. After the routine starts at a step 120, the next step in FIG. 7 at 122 is to determine whether the AC_Offset value would need to be scaled, by a factor which compensates for intended change in belt velocity relative to the calibration velocity which can occur to run the process at, for example, half speed or some other predetermined speed. Once the AC control has been enabled, the motor reference period is adjusted by the AC zone Offset value. A zone clock is also provided which is used to index through the total number of zones in the compensation table. In the preferred embodiment, this clock may be the motor output encoder signal.

The ITM motor is then energized (or initiated) at a step 124, and the engine-controller begins looking for the home sensor activation signal at a step 126. Once the home sensor signal has been activated, as determined by a decision step 128, the motor reference period begins to be modulated by the amplitudes described in the compensation table. As the motor continues to run, the motor encoder output signal is used to increment through the compensation table.

The motor velocity is adjusted at a step 130, based upon table values for each specific zone. A decision step 132 determines when the next home position occurs, and the logic flow then continues to a logic routine represented by a block 140, which represents another flow chart as depicted on FIG. 8.

The number of zones in the table was developed to be nominally equal to the number of motor encoder pulses edges within the nominal belt length. Given manufacturing tolerances, belt creep over life, and belt shrinkage and expansion due to thermal considerations, it is unlikely that the number of zones in the compensation table will be commensurate with the number of encoder pulses in any given belt revolution. The preferred embodiment described below, allows for discrepancies between the number of zones in the compensation table, and the equivalent number of encoder pulses in a given belt revolution, whereby the control logic indexes through the compensation table at varying rates, based upon the number of detected encoder edges within a given belt revolution, as compared to the number of zones within the compensation table.

While indexing through the compensation table, if the logic flow arrives at the end of the table prior to seeing the next home index signal, the compensation table rolls-over and the control logic begins indexing through the table again. The zone rate update routine 140 begins at a step 142. Once the home sensor signal has been sensed, the following two items are calculated, (1) the "Last Zone Used" in the table at a step 144, and (2) the number of encoder pulse edges (also referred to as "Belt_zones_per_rev") in the last revolution, at a step 146. In steady state operation, the number of encoder pulse edges per belt revolution is consistent within a few zones, dependent on parameters such as belt stretch and temperature.

If the compensation table rolls over, the number of encoder pulse edges per revolution is greater than the number of zones in the compensation table. The system can be thought of as having run "too quickly" through the table. The table size correction value is calculated by subtracting the encoder pulse edges per revolution (also referred to as "Belt_zones_per_rev") from the number of Table_zones. The phase relationship between the home sensor signal and the start of the compensation table also needs to be corrected. The phase correction is accomplished by first determining if the Last_Zone_Used occurred at the end of the table or at the beginning. A decision step 150 makes this determination by first dividing the total number of zones by two (2), and comparing the result to the Last_Zone_Used value. If the table rolled over, then the result at decision step 150 will be NO, and the logic flow is directed to a step 154; otherwise it will be YES, and the logic flow is directed to a step 152.

If the compensation table rolls-over, then consequently the Last_zone_Used occurred in the beginning of the table, and the Position Correction value is equal to (−Last_Zone_Used) at step 154. Conversely, if the table is run-through "too slowly," the Last_Zone_Used will be at the end of the table, at step 152. The Position_correction is then calculated as the Last_Zone_Used, subtracted from the Table_zones. The total correction is the summation of the Table_size_correction and the Position Correction values, at a step 156. The correction interval is then calculated at a step 158 as being equal to the number of motor pulse leading and lagging edges (as determined by the Hall sensor), divided by the absolute value of the Total Correction, added to a value of +1, with this overall quotient added to a value of −1. The zone rate update routine is then finished for this belt revolution.

FIGS. 9–12 describe the phasing correction between the compensation table, and the Belt_zones. If the Total_correction value is negative (i.e., "went through table too quickly" or "too fast"), then there would have been a larger number of encoder pulse edges per revolution (i.e., Belt_Zones) than Table_zones, as illustrated at 170 on FIG. 9. On the next belt revolution, by not applying the table correction at the appropriate interval, the control logic may effectively shift the compensation table down, such that by the next home sensor signal, the "end of the compensation table," and the "end of the belt zones" are matched. This example is depicted at 172 on FIG. 10.

If the Total_correction value is positive (i.e., the logic "Went through belt too slowly"), then there would have been a smaller number of Belt_Zones than Table_zones, as illustrated at 180 on FIG. 11. By applying the table correction from two zones simultaneously at the appropriate interval, the control logic may effectively shift the compensation table up, such that by the end of the next home sensor signal, the "end of the compensation table," and the "end of the belt zones" are matched (as depicted in the example at 182 on FIG. 12). In this manner, the control logic may keep a phased relationship between the compensation table and the Belt home sensor, even if the number of Belt_zones changes over time, due to creep and thermal considerations.

The same correction table can be used when printing at other resolutions. For instance at 1200 dpi with the belt velocity set to one half of the 600 dpi belt velocity, zone length remains nominally 0.5 mm. The zone clock period is doubled with the 0.01% velocity changes produced by 254 nanosecond increments to the motor clock period rather than 127 nanosecond increments.

By use of the invention misregistration error can be substantially reduced. The peak to peak positional error between stations can be reduced from about 100 micrometers without correction to about 20 micrometers with correction, thereby providing a significant improvement in performance.

Figure 4:
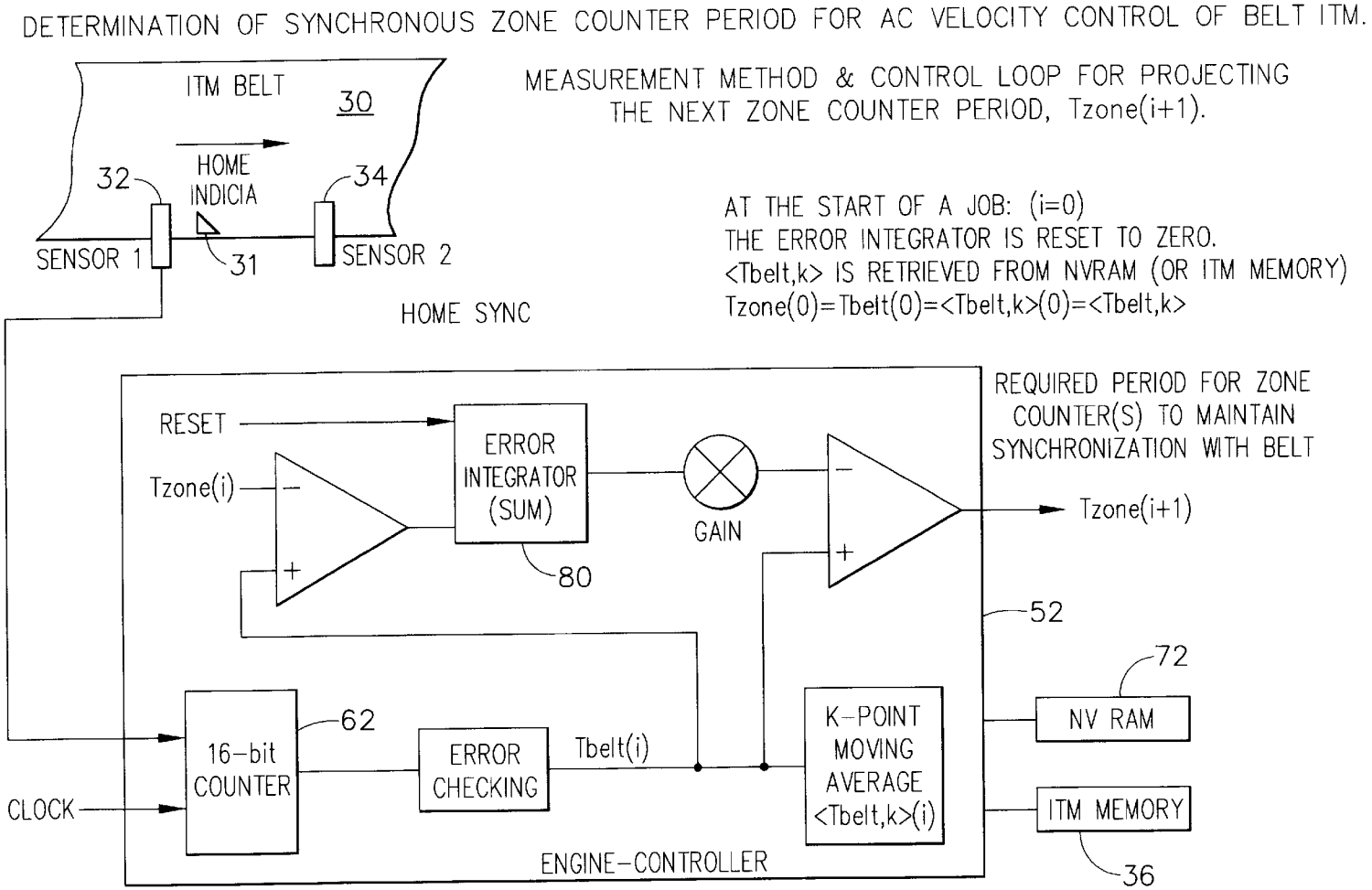
FIG. 4 is a schematic block diagram illustrating one aspect of AC velocity control in accordance with the invention.
Figure 5:
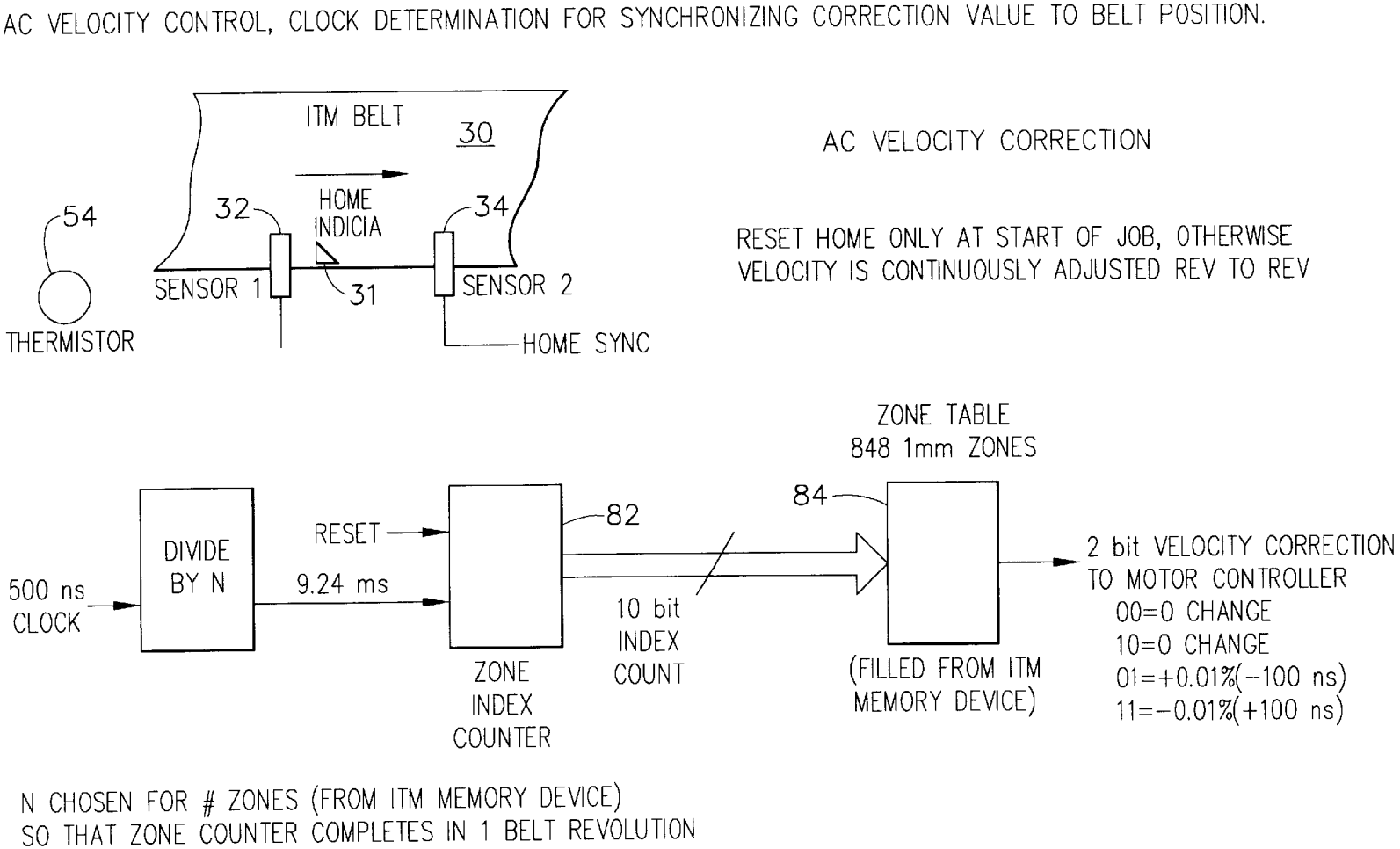
FIG. 5 is a schematic block diagram illustrating another aspect of AC velocity control in accordance with the invention.

An alternate methodology for determining the zones will now be described. The engine-controller algorithm and associated hardware to maintain synchronization of the zone counter and velocity correction table relative to the belt home indicia is depicted in FIGS. 4 and 5. As shown in FIG. 4, the first step is to determine the home to home transit time and to project the required period for the zone counter 62 on the next revolution of the belt 30 to maintain synchronization of the home indicia 31. The second step as shown in FIG. 5 is to provide a clock and counter that indexes through the total number of zones in the velocity correction table during one belt revolution.

FIG. 4 illustrates the method of determining the clock period for the zone counter 62. This measurement is performed after the belt DC velocity has been set. The initial time from home to home is stored in memory 36 for use until a moving average has evolved from multiple measurement cycles in the machine. The current value of the moving average <Tbelt,k> is maintained by NVRAM 72. When a new subassembly is installed into the printer, which is recognizable by the unique serial number stored in memory 36, the NVRAM value is reinitialized.

As shown in FIG. 4 at the start of a job and prior to imaging, the error integrator 80 is reset to zero, the average time for a belt rotation <Tbelt,k> is retrieved from NVRAM 72, and variables Tzone(0) and Tbelt(0) are initialized to the retained average <Tbelt,k>.

Sensor 32 is used to detect the home indicia 31 and the time from home to home is measured by counting a fixed clock. Temperature correction of this counted time is not required because the associated belt length error is small and rapidly integrated out by the error integrator 80. The first measured value is Thelt(1) and successive values are labeled Tbelt(i). The k-point moving average <Tbelt,k> is updated to include each new measurement and is saved periodically to NVRAM 72.

As is shown schematically in FIG. 4, the difference from the measured time for a belt revolution Thelt(i) and the predetermined zone period Tzone(i) is computed and summed to produce an integrated error. This integrated error is multiplied by a gain factor and added to the current belt time Tbelt(i) to determine the zone clock period for the next revolution of the belt Tzone (i+1).

From the start of a printing job:

Tzone(0)=Tbelt(0)=<Tbelt,k>(0)=<Tbelt,k>.

Tzone(1)=Tbelt(0)=<Tbelt,k> at startup

Tzone(2)=Tbelt(1)+Gain*[Tbelt(1)−Tzone(1)]

Tzone(i+1)=Tbelt(i)+Gain*sum[Tbelt(n)−Tzone(n)]/n=1 to i

In the preferred embodiment the Gain is 1 and k is 32. The moving average <Tbelt,k> is computed as:

<Tbelt,k>(i+1)=[31*<Tbelt,k>(i)+Tbelt(i)]/32

Other running or weighted averages can alternatively be employed. Convergence in response to a disturbance is rapid, typically one belt revolution, and without ringing with the integrator gain multiplier set to 1. Gain may also be of other values to suit desired performance. Error checking may be added to assure that the current measured time is within an acceptable window such as within ±5% of <Tbelt, k> prior to processing.

The moving average is maintained at the 600 dpi process speed. If the machine is operated at other speeds such as half speed 1200 dpi, either a second moving average can be created or the existing value scaled inversely.

FIG. 5 shows the technique for providing a clock that counts through the length of the velocity correction table in one revolution of the belt. The total clock period for the zone counter Tzone(i+1) is obtained as described above. The total number NZ of zones for velocity correction, that is the table length, is retrieved from memory 36. The engine-controller determines the clock period required to count through NZ zones in time Tzone(i+1) as Tclock(i+1)=Tzone (i+1)/NZ. This clock period is then generated using a programmable counter 82 with fixed input clock period which is nominally 500 nanoseconds. The division ratio for the counter 82, N(i+1), is chosen so that N(i+1)=Tclock(i+1)500 nanoseconds.

The zone index counter 82 provides a count input to the velocity correction table 84 that indexes through the table in one belt revolution. By updating Tzone for each revolution of the belt, integration of accumulated errors results in maintaining NZ zone counts per belt revolution. The velocity correction table is initially synchronized to the home indicia 31 in the belt relative to the second sensor 34 at the start of a job and prior to the start of imaging. The zone clock is subsequently updated from Tclock(i) to Tclock(i+1) upon detection of the home indicia at the second sensor.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

What is claimed is:

1. An apparatus for providing transfer quality optimization of color planes transferred to or from a transfer belt of an image forming apparatus comprising:

a plurality of transfer rollers;

a transfer belt disposed about said plurality of transfer rollers;

a memory capable of storing data relating to said transfer belt at multiple transfer stations;

a home position indicator associated with said transfer belt;

first and second sensors for sensing said home position indicator;

a temperature sensor for sensing temperature near a surface of the transfer belt;

a drive assembly for driving the transfer belt; and an engine-controller in communication with said memory, said sensors, and said drive assembly, said engine-controller operative to provide adjustment of motion errors of said drive assembly due to: (a) variations in thickness of said transfer belt over its length, and (b) changes in temperature causing variations in the length of said transfer belt.

2. The apparatus of claim 1 wherein said image forming apparatus comprises a printer.

3. The apparatus of claim 1 wherein said memory comprises a semiconductor memory.

4. An apparatus for providing transfer quality optimization of color planes transferred to or from a transfer belt of an image forming apparatus comprising:

a plurality of transfer rollers;

a transfer belt disposed about said plurality of transfer rollers;

a memory capable of storing data relating to said transfer belt at multiple transfer stations;

a home position indicator associated with said transfer belt;

first and second sensors for sensing said home position indicator;

a temperature sensor for sensing temperature near a surface of the transfer belt;

a drive assembly coupled to said plurality of transfer rollers for driving the transfer belt; and an engine-controller in communication with said memory, said sensors, and said drive assembly, said engine-controller operative to provide adjustment of said drive assembly in accordance with the contents of said memory, and a temperature signal from the temperature sensor.

5. The apparatus of claim 4 wherein said home position indicator is selected from the group consisting of a reflective tape adhesively bonded to said transfer belt, a hole extending through said transfer belt, indicia printed on said transfer belt, indicia painted on said transfer belt, a magnetic device disposed on said transfer belt and an electrostatic device disposed on said transfer belt.

6. The apparatus of claim 4 wherein said sensor is selected from the group consisting of an optical sensor, an indicia reader, a magnetic detector, and an electrostatic detector, wherein said sensor is operative to provide a signal indicating detection of said home position indicator.

7. The apparatus of claim 4 wherein said controller is operative to provide adjustment of said drive assembly in accordance with temperature compensated velocity data.

8. The apparatus of claim 4 wherein the memory contains averaged velocity data for the transfer belt and data on the time between home sensors to achieve a known belt surface velocity at a known temperature.

9. The apparatus of claim 8 wherein the engine-controller is operative in response to data from the memory and from the temperature sensor and position sensors to provide feed forward velocity control of the drive assembly.

10. The apparatus of claim 4 wherein the engine-controller is operative to provide DC and AC velocity control of the transfer belt.

11. The apparatus of claim 4 wherein the memory stores data representative of a moving average of differential rime measurements derived from the position sensors, and temperature compensation for expected thermal expansion of the drive roll and the transfer belt.

12. The apparatus of claim 4 wherein the sensors are spaced apart by a distance related to the circumference of the drive roll for the transfer belt, and wherein the sensors provide a signal representative of average belt velocity.

13. The apparatus of claim 4 wherein the temperature sensor is a thermistor providing a signal representative of drive roll temperature; and wherein the memory contains temperature compensation data employed in conjunction with temperature measured by the thermistor to provide an output representing thermally compensated velocity data.

14. For use in a color printer having a plurality of color planes deposited onto a transfer belt, an apparatus for providing transfer belt position conection, comprising:

(a) a transfer belt subassembly including:

(i) a transfer belt disposed about a plurality of rollers and having a home position indicator;

(ii) a temperature sensor disposed to sense temperature near a surface of the transfer belt and to provide a signal representative thereof; and (iii) a memory capable of Storing transfer belt calibration data, (b) a drive assembly for driving the transfer belt; and (c) an engine-controller in communication with said memory, said temperature sensor, and said drive assembly, said engine-controller operative to provide adjustment of said drive assembly in accordance with: (i) the transfer belt calibration data stored in said memory, and (ii) said signal from the temperature sensor.

15. The apparatus of claim 14 further including at least one sensor for sensing the home position indicator.

16. The apparatus of claim 15 wherein the home position indicator comprises one of a hole through, or an indicia upon, the transfer belt.

17. The apparatus of claim 14 wherein the memory is a semiconductor memory.

18. The apparatus of claim 17 wherein the semiconductor memory is non-volatile.

19. The apparatus of claim 14 wherein the transfer belt subassembly is a field replaceable unit.

20. The apparatus of claim 14 wherein said temperature sensor senses a temperature near a drive roll.

21. A method of controlling transfer belt position in a color printer having a plurality of color stations, and a transfer belt subassembly having a transfer belt disposed about a plurality of rollers, a temperature sensor, a belt position sensor, a memory, and a variable speed motor for driving the transfer belt about the rollers, the method comprising:

storing characterizing data for the transfer belt in the memory which represents the measured velocity profile for the transfer belt; and providing drive signals to the variable speed motor in response to data from the memory and signals from the sensors to control the speed of the motor and the speed of the transfer belt to provide nearly constant surface velocity between color stations of the printer.

22. The method of claim 21 wherein the step of storing includes:

providing a second belt position sensor; and storing averaged velocity data for the transfer belt and data on the time between sensors to achieve a known belt surface velocity at a known temperature.

23. The method of claim 22 wherein the step of providing includes:

providing feed forward velocity control of the motor.

24. The method of claim 22 wherein the step of providing includes:

providing DC and AC velocity control of the motor.

25. The method of claim 22 wherein the steps of storing includes:

providing a second belt position sensor; and storing data representative of a moving average of differential time measurements derived from the sensors, and temperature compensation for expected thermal expansion of the drive roll and the transfer belt.

26. The method of claim 21, further comprising:

using a difference between an actual temperature sensor value and a predetermined reference temperature value, adjusting a motor speed to maintain a substantially constant belt velocity.

27. The method of claim 26, wherein said adjusting step comprises:

determining a slope value from data stored in memory from said difference between the actual temperature sensor value and the predetermined reference temperature value, thereby deriving said motor speed adjustment.

28. A printer having a motion-controlled transfer belt comprising:

a plurality of rollers;

a transfer belt disposed about said plurality of rollers;

an indicator disposed on said transfer belt;

a plurality of sensors disposed adjacent said transfer belt, each of said plurality of sensors capable of sensing the indicator;

a memory for storing data representing transfer belt characteristics;

a motor for driving said transfer belt; and a controller in communication with said plurality of sensors, said memory and said motor, said controller operative to adjust the speed of the motor in accordance with the contents of the memory to compensate for motion inaccuracy of said transfer belt based on the velocity profile of the transfer belt.

29. The apparatus of claim 28 wherein a distance between adjacent sensors of said plurality of sensors is approximately equal to a distance between adjacent color stations of said printer.

30. The apparatus of claim 28 wherein said motor comprises a stepper motor.

31. The apparatus of claim 28 wherein said motor comprises a brushless D.C. motor.

32. The apparatus of claim 28 further including a temperature sensor for sensing the temperature of a surface of the transfer belt;

and wherein the controller receives temperature data from the temperature sensor and is operative to provide speed control of the motor compensated for temperature.

33. An image forming apparatus having a motion-controlled transfer belt comprising:

a plurality of rollers;

a transfer belt disposed about said plurality of rollers;

an indicator disposed on said transfer belt;

a sensor disposed adjacent said transfer belt, for sensing said indicator;

a memory for storing data representing transfer belt characteristics;

a motor for driving said transfer belt;

a controller in communication with said sensor, said memory, and said motor, said controller operative to run said transfer belt at a predetermined default motor speed for an entire belt revolution, as detected by said position sensor; and said controller further operative to count motor output pulses during said belt revolution, and to adjust said belt speed accordingly to run at a substantially constant velocity.

34. The Image forming apparatus of claim 33, wherein said belt speed adjustment occurs by varying a motor clock frequency, based upon a lookup table value stored in said memory.

35. The image forming apparatus of claim 34, wherein an occurrence of said indicator passing by said sensor commences the belt speed adjustment function for each belt revolution.

* * * * *